US008979429B2

(12) United States Patent
Nankervis

(10) Patent No.: US 8,979,429 B2
(45) Date of Patent: Mar. 17, 2015

(54) DRAINAGE AND MATERIAL-SETTLING DEVICE FOR CONVEYANCE CHANNELS

(76) Inventor: James M. Nankervis, Berthoud, CO (US)

( * ) Notice: Subject to any disclaimer, the term of this patent is extended or adjusted under 35 U.S.C. 154(b) by 226 days.

(21) Appl. No.: 13/605,208

(22) Filed: Sep. 6, 2012

(65) Prior Publication Data

US 2014/0064851 A1 Mar. 6, 2014

(51) Int. Cl.
*E02B 3/04* (2006.01)
*E02B 5/08* (2006.01)

(52) U.S. Cl.
CPC *E02B 5/085* (2013.01); *E02B 3/043* (2013.01)
USPC ..... 405/21

(58) Field of Classification Search
USPC ..... 405/15, 21, 30, 34, 35, 74, 107, 114, 405/118, 302.6; 256/12.5
See application file for complete search history.

(56) References Cited

U.S. PATENT DOCUMENTS 2,792,115 A * 5/1957 Medearis ..... 209/223.1
2004/0164285 A1* 8/2004 Bernasconi ..... 256/12.5

* cited by examiner

*Primary Examiner* — Sunil Singh
(74) *Attorney, Agent, or Firm* — Jennifer S. Stachniak; Robert W. Becker

(57) ABSTRACT

A drainage and material-settling device for conveyance channels, comprising an elongated base member for placement in a channel transverse to the main direction of flow through the channel. A plurality of spaced-apart upright members extend from one side of the base member. At least two anchor members extend from the other side of the base member and are placed in a subsurface of the channel. That number of upright members corresponding to the number of anchor members are secured to the anchor members such that the base member is sandwiched between the anchor members and the upright members. Those upright members not secured to anchor members are secured to further connecting members.

21 Claims, 12 Drawing Sheets

DRAINAGE AND MATERIAL-SETTLING DEVICE FOR CONVEYANCE CHANNELS

BACKGROUND OF HE INVENTION

The present invention relates to a drainage and material-settling device for conveyance channels, including man-made and natural channels and ditches.

It is an object of the present application to provide a drainage and material-settling device that allows an improved settlement of material and/or sediment deposition in channels or ditches while allowing drainage of the channel or ditch.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Applicant's drainage and material settling device for conveyance channels comprises an elongated base member that is configured to be placed in a channel transverse, in other words perpendicular or at an angle, to the main direction of flow through the channel, which can for example, be a man-made or natural channel or ditch; a plurality of spaced-apart upright members that extend from one side of the base member; at least two anchor members that extend from the other side of the base member and are configured to be placed in a subsurface of the channel, with the upright members thus extending into the channel space, and wherein that number of upright members that correspond to the number of anchor members are secured to the anchor members in such a way that the base member s sandwiched between the anchor members and the upright members; and further connecting members, wherein those upright members that are not secured to the anchor members are secured to these further connecting members and to the base member. Extensions can be mounted to one end of the upright members, with the free end of each extension then being secured either to the anchor members or to the further connecting members. Additionally, respective grommet saddles can be disposed between the base member and the free ends of each extension. Furthermore, an elastomeric insert can be provided and can be disposed in an aperture of the grommet saddle and in a hole in the base member, wherein an end of a nipple, the other end of which is threaded into the extension of the upright member, extends through the elastomeric insert and presses external ribbing thereof against the wall of the hole in the base member to bring about securement of the extension, and hence of the upright member, to the base member. An advantage of applicants drainage and material-settling device is that it prevents build-up of standing water over an extended period of time in the channel or ditch by bringing about settlement of at least some of the material and heavy sediment in the channel or ditch while allowing drainage of the channel or ditch. One application of applicant's device is in conveyance channels or ditches downstream of cattle pens but upstream of settling basins and lagoons.

Further specific features of the present application will be described in detail subsequently.

DESCRIPTION OF SPECIFIC EMBODIMENTS

Figure 1A:
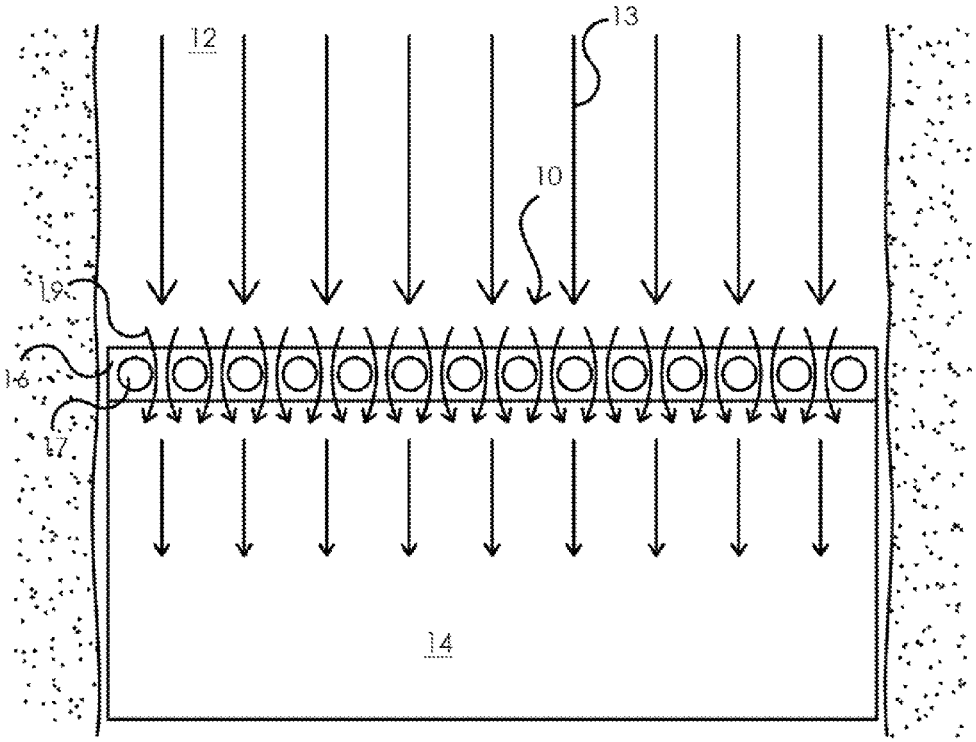
FIG. 1A is a top view onto one exemplary embodiment of applicant's drainage and material-settling device in place in a ditch or channel.

Referring now to the drawings in detail, in the top view of FIG. 1A, one exemplary embodiment of applicant's drainage and material-settling device is shown placed in a channel or ditch, by way of example only a ditch for the runoff in cattle feed lots. Such a channel or ditch can be a natural or man-made conveyance channel or ditch. In the illustrated configuration, the drainage and material-settling device, which is indicated generally by the reference numeral 10, is disposed in the channel 12 so as to extend transverse, here substantially perpendicular, to the main direction of flow in the channel, which is indicated by the arrows 13. Although to facilitate illustration only a single drainage and material-settling device is illustrated, for example having an overall width of five feet, for wider channels it may be expedient to use a number of separate, abutting drainage and material-settling devices to span the channel width. Also shown in FIG. 1A, on the downstream side of the drainage and material-settling device 10, is a so-called scour apron 14, the function of which will be described subsequently.

Figure 1B:
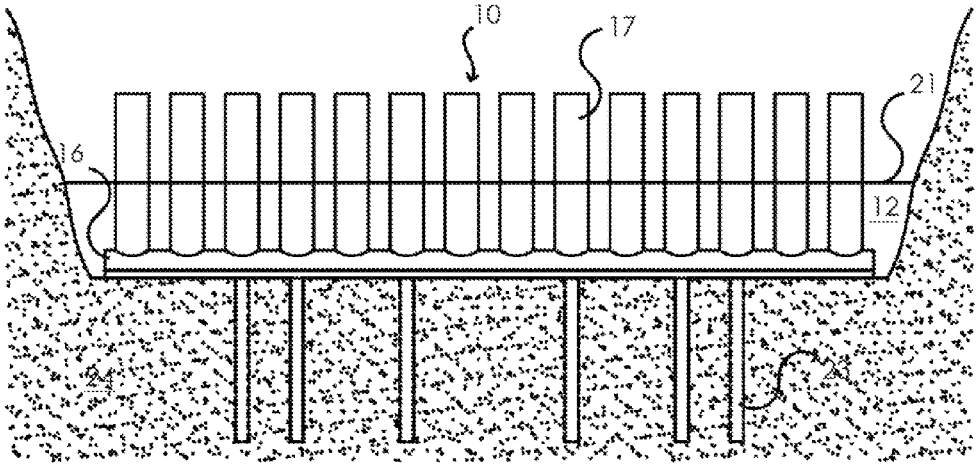
FIG. 1B is a partially sectioned from view of the drainage and material settling device of FIG. 1.
Figure 2:
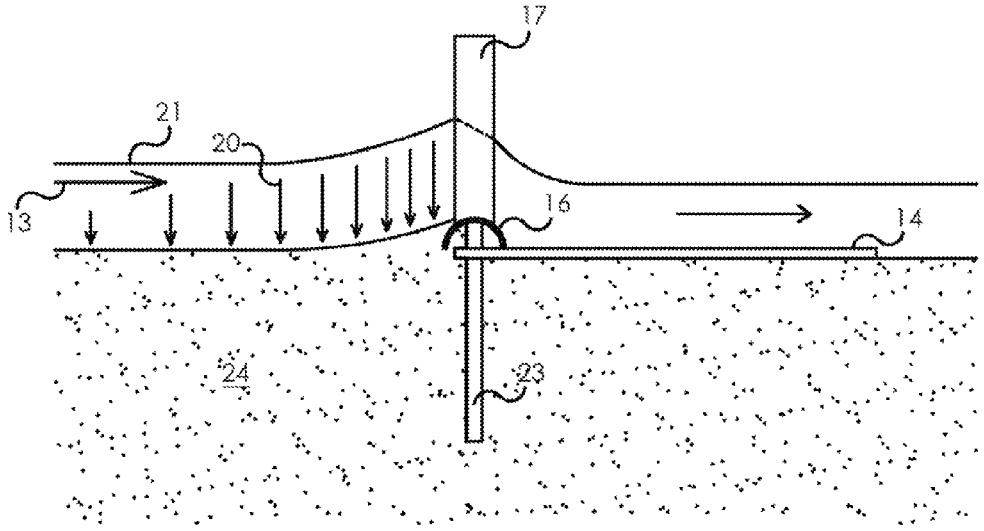
FIG. 2 is a partially sectioned side view of the drainage and material-settling device of FIG. 1.
Figure 3A:
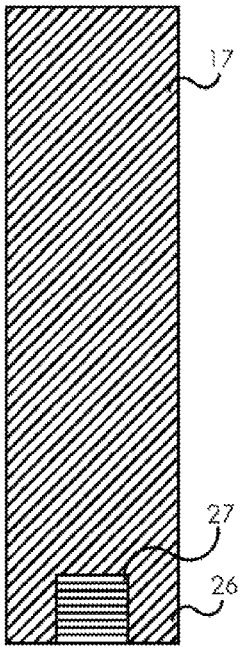
FIG. 3A is a cross-sectional view through the upright member of the drainage and material settling device of FIG. 1.
Figure 3B:
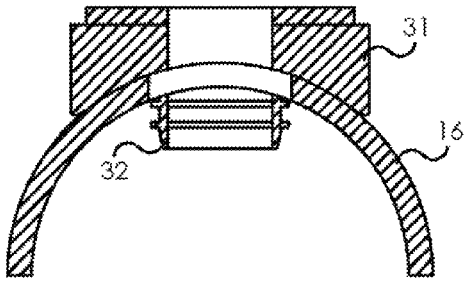
FIG. 3B is a cross-sectional view through a grommet and the base member of the drainage and material settling device of FIG. 1.

As can be seen in FIGS. 1A and 1B, the drainage and material-settling device 10 has a base member 16 which is made, for example, from PVC, polypropylene, or the like, and that in this embodiment extends substantially perpendicular or transverse to the main direction of flow 13 from one side of the channel 12 to the other side thereof. The base member 16 is placed as fleshly as possible on the upper surface of the channel 12, for which purpose it may be necessary to level the upper surface somewhat. Extending upwardly from the base member 16 into the channel 12 are a plurality of spaced-apart upright members 17, sometimes also referred to as verticals. These upright members 17, which can be made of polypropylene, for example isotactic polypropylene, are spaced apart by a sufficient distance, by way of example only 41 mm for a 64 mm diameter upright member to produce a 60/40 solid to opening ratio, to allow water and small material and sediment to pass through gaps between adjacent ones of the upright member 17, as indicated by the arrows 19 in FIG. 1A, while trapping larger material and sludge on the upstream side of the upright member 17. Due to the presence of the upright member 17, and a slowing down in the velocity of flow, this larger material and heavy sludge settles, as indicated by the arrows 20 in FIG. 2. Further settling of material downstream of the upright member 17 can also occur. To illustrate the situation in which water is flowing in the channel 12, for example after a rainfall, an exemplary water level 21 in the channel 12 is shown in FIGS. 18 and 2. It should be noted that the upright members 17 need not necessarily be spaced equidistantly apart (see, for example, FIGS. 10-12).

Figure 7A:
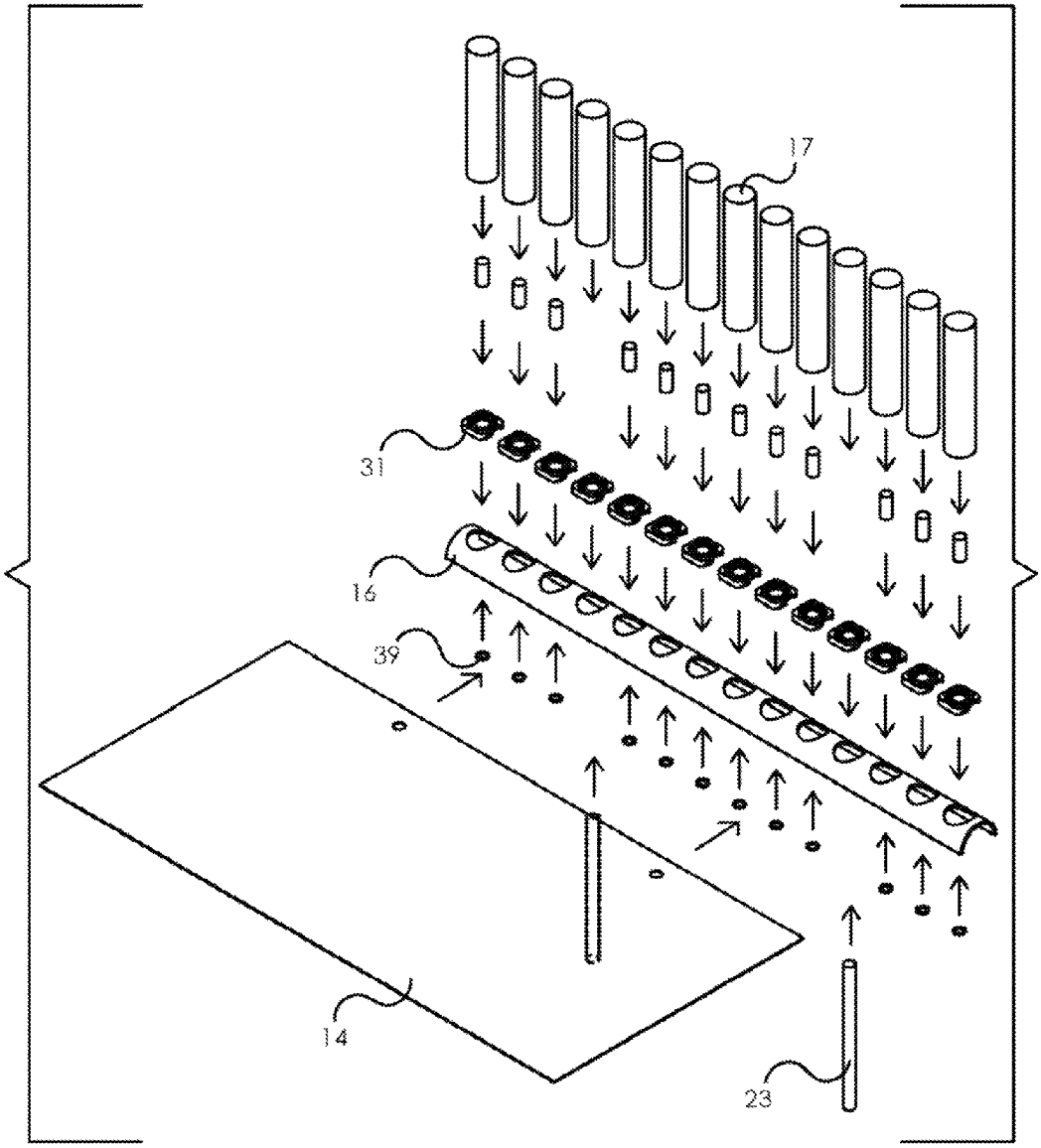
FIG. 7A is an exploded view of an exemplary configuration of applicant's drainage and material settling device.
Figure 7B:
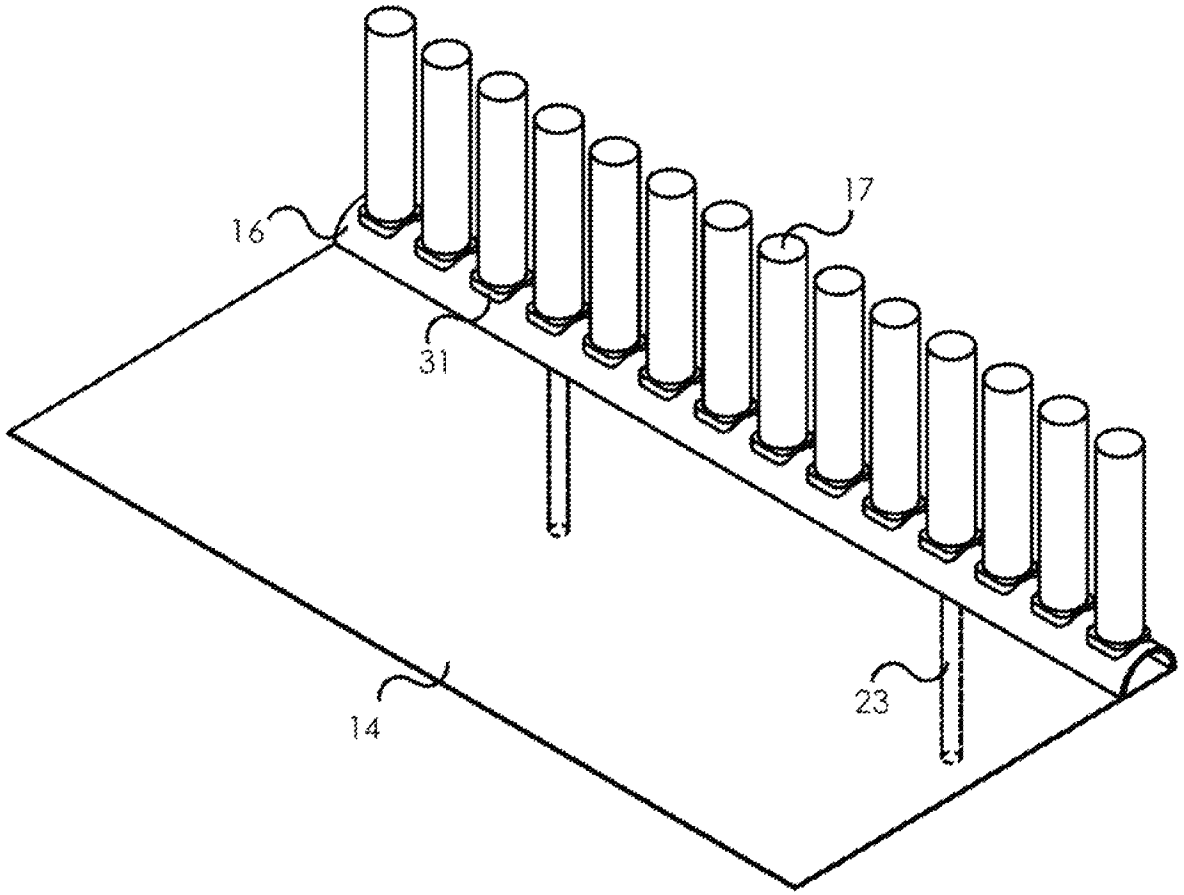
FIG. 7B shows the drainage and material settling device of FIG. 7A in an assembled state.

The drainage and water-settling device 10 of the present application also has at least two anchors 23, which are introduced into the sub-surface 24 of the channel 12 to hold the drainage and material-settling device 10 in place in the channel. The anchors 23, which are preferably made of stainless steel, can be driven into the ground or subsurface 24 before the base member 16 is placed over them, or the base member 16 can first be placed on the ground, and the anchors can then be driven through holes provided in the base member. Although two anchors 23 are often sufficient, as shown by way of example in FIGS. 7A and 7B, for longer drainage and material-settling devices 10 and/or where strong flows are anticipated in the channel 12, a central anchor 23 and even additional anchors 23 can be provided. A corresponding number of upright members 17 are attached to the anchors 23 in a manner to be described in greater detail subsequently. Those upright members 17 not attached to anchors can be held in the base number 16 by friction and/or by further connecting members, as will also be discussed in detail subsequently.

FIGS. 3-6 show greater details concerning the drainage and material-settling device 10. The basic components of the device 10 are the base member 16, the upright members 17 and some anchors 23, and possibly also at least one part of a grommet.

Figure 4C:
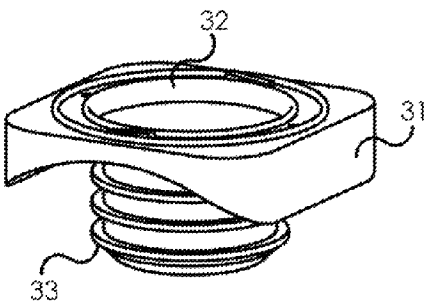
FIG. 4C shows the two-piece grommet of FIG. 4A in an assembled state.
Figure 4B:
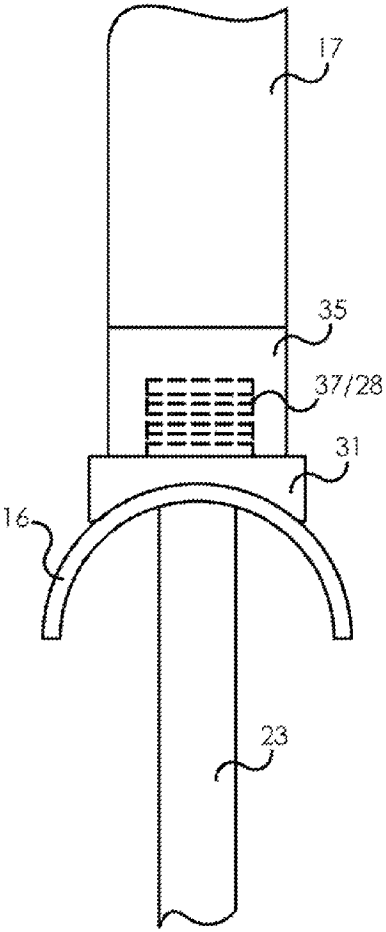
FIG. 4B shows the drainage and material settling device of FIG. 4A in an assembled state, but without the elastomeric insert of the grommet.
Figure 4A:
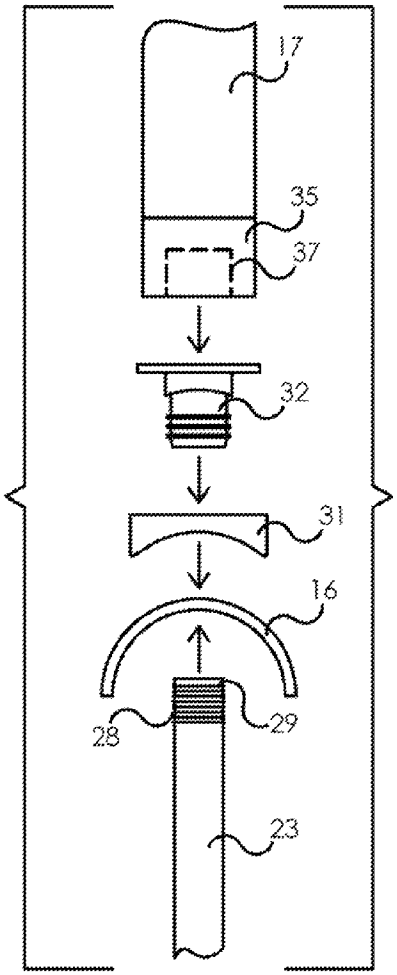
FIG. 4A is an exploded view of one exemplary embodiment of applicant's drainage and material settling device.

The attachment, in the form of a threaded connection of the upright member 17 to an anchor 23 or some other connecting member, is shown in various exemplary embodiments in FIGS. 4-6. For example, in FIGS. 4A and 4B. For example, in FIGS. 4A and 4B, the upright member 17 is provided at its lower end 26 with an internal female threaded portion, indicated by the dashed lines 27, that allows it to be threaded onto the external, male threads 28 that are provided on the upper end 29 of the anchor 23.

To provide a tighter fit between the components of the drainage and material-settling device 10, a grommet, for example of rubber can be placed on the round or convex surface of the base member 16, with the flat base or end 26 of the upright member 17 being seated on the grommet saddle 31 after the upright member 17 has been threadedly connected and drawn to the anchor 23. An elastomeric insert 32, for example of natural or synthetic rubber or silicone, for the grommet saddle 31 can also be provided. The elastomeric insert 32 allows the grommet saddle to be securely transported along with the base member 16 in that the ridges or ribbing 33 on the elastomeric inserts 32 provide a friction fit with the holes in the base member 16. The ribbing 33 can also provide a connection means for holding those upright members 17 not connected to anchors 23 in the base member 16 without the use of a separate connecting member, as will be discussed in greater detail subsequently.

Although as described above the upright members 17 can be threadedly connected directly to the anchors 23 (as illustrated schematically in FIGS. 2 and 3A), it may be expedient to provide the upright member 17 with respective extensions 35 (see FIGS. 4 to 6), which can also be made of polypropylene. The extension 35 can either be threaded into female threads 27 of the upright member 17 via male threads provided at one smaller diameter end 36 of the extension 35, or pursuant to a presently preferred embodiment, the upright member 17 can be in the form of a tube and can be slid over the smaller diameter end 36 of the extension 35, as indicated schematically in FIG. 5A, with the outer diameter of the reduced diameter end 36 being substantially the same as the inner diameter of the tubular upright member 17, and with the outer diameter of the remainder of the extension 35 being the same as the outer diameter of the tubular upright member 17 so as to be flush therewith. No threads are involved in this slip connection of the upright member 17 with the extension 35; rather, the upright member 17 and the flushly adjoining outer surface of the extension 35 are "welded" together, for example with a strip of polypropylene, to seal the seam between the upright member 17 and the extension 35.

The other end of the extension 35 opposite the smaller diameter end 36 is provided with a female threaded portion 37, which essentially corresponds to the female threads 27 of the upright members 17 as described above. In the embodiment illustrated in FIGS. 4A and 4B, the anchor 23 can then be threaded into the female threads 37 of the extension 35, rather than being threaded directly into the upright member 17, whereupon the base member 16 is then sandwiched between the extension 35 and the base member 16. The grommet saddle 31, perhaps without the elastomeric insert 32, as shown in FIG. 4B, can be interposed between the extension 35 and the base member 16 for the purpose previously described.

Figure 5C:
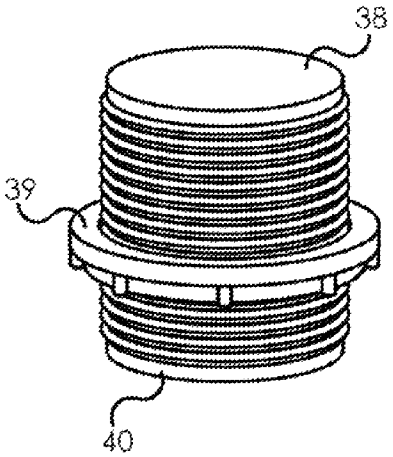
FIG. 5C is an enlarged view of the optional lock nut threaded onto the exposed end of the nipple of the drainage and material settling device of FIG. 5B.
Figure 5B:
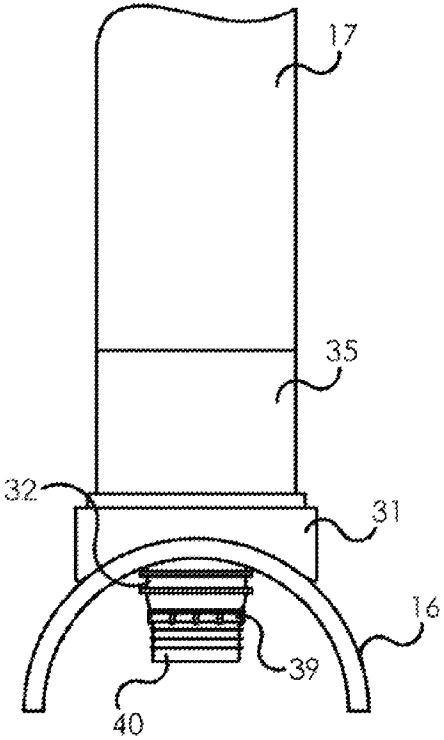
FIG. 5B shows the drainage and material settling device of FIG. 5A in an assembled state.
Figure 5A:
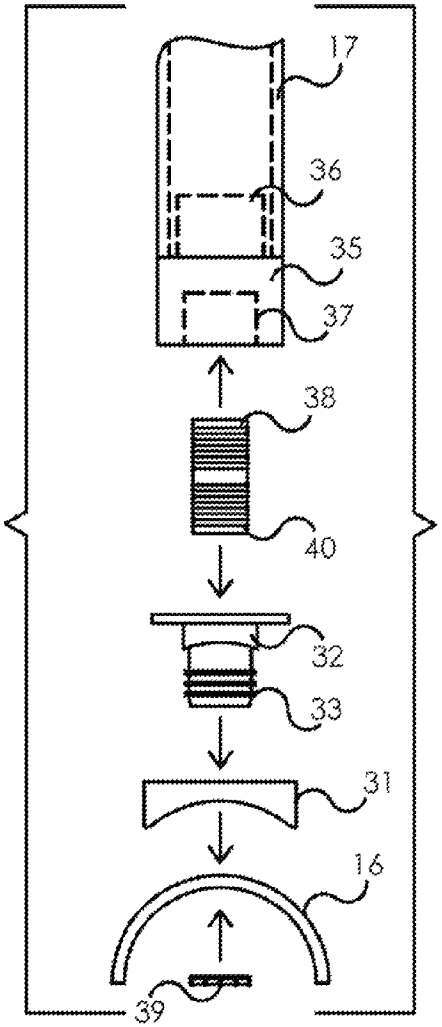
FIG. 5A is an exploded view of another exemplary embodiment of applicant's drainage and material settling device.

In the embodiment illustrated in FIG. 5A a so-called nipple 38, which is threaded at both ends, is provided. One of the threaded ends of the nipple 38 is threaded into the female threads 37 of the extension 35, or directly into the lower end 26 of the upright member 17 if no extension is provided. The other threaded end 40 of the nipple 38 is then pushed into and partially through an elastomeric insert 32 that is disposed in a grommet saddle 31 and in a hole of the base member 16, thereby expanding the ribbing 33 of the elastomeric insert 32 against the wall of the hole to securely hold the upright member 17 in the base member 16 and against the grommet saddle 31. Although in many cases this friction fit attachment of the upright member 17 to the base member 16 is adequate by itself, it may also be expedient to provide additional securement means. For example, as illustrated in FIG. 5B, a lock nut 39 or similar holding means can be threaded onto the exposed threaded end 40 of the nipple 38 to secure the nipple against the elastomeric insert 32 or even against the base member 16 itself (see also FIG. 5C). It should also be noted that the elastomeric insert 32 can act as a shock absorber to reduce stress on the base member 16.

Although the nipple 38 has been described as having two threaded ends, which is particularly convenient where a lock nut 39 or the like is to be used, the free end of the nipple 38 when its one end 10 is threaded into the female threads 37 of the extension 35 can merely be smooth or can be provided with a non-thread profile, wherein the outer diameter of this free end 40 of the nipple 38 could be slightly greater than the inner diameter of the elastomeric insert 32 so as to provide a positive, friction fit when the free end 40 of the nipple 38 is pushed into the elastomeric insert 32.

Figure 6B:
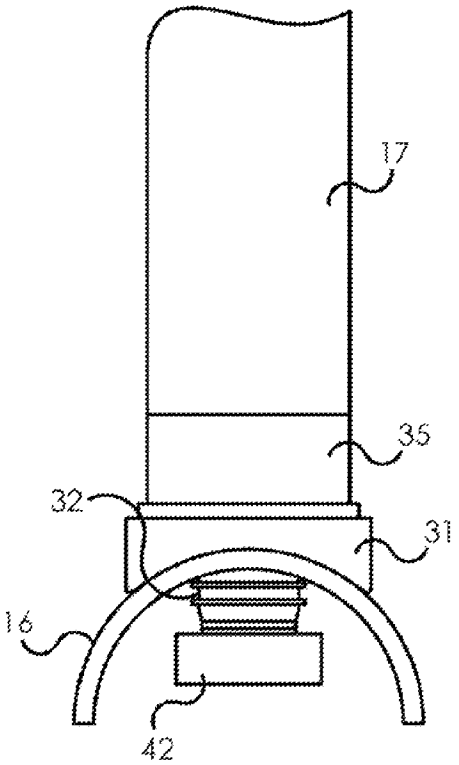
FIG. 6B shows the drainage and material settling device of FIG. 6A in an assembled state.
Figure 6A:
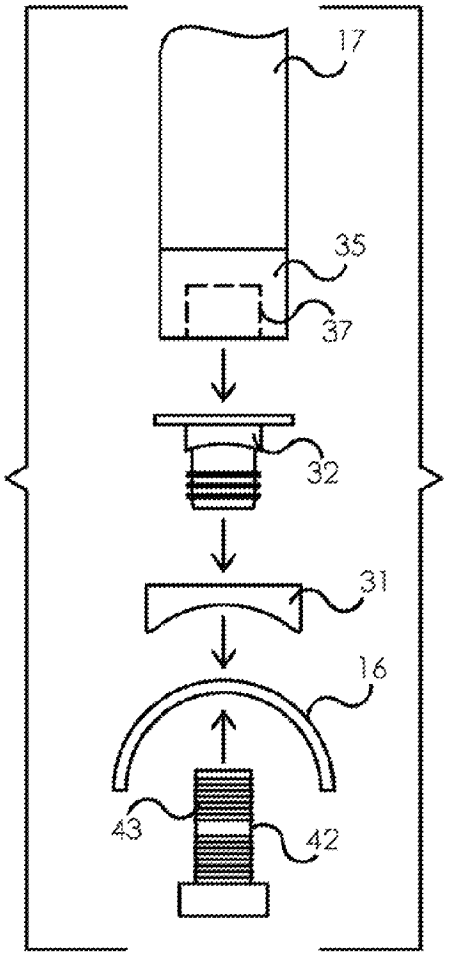
FIG. 6A is an exploded view showing a further option for securing an upright member to a base member.

FIGS. 6A and 6B show a different connection member for the case where the upright member 17 is not connected to an anchor 23. In this embodiment, a connection member, for example a wide-headed bolt 42, is threaded via a threaded shaft 43 either directly into female threads 27 of the upright member 17, or into the female threads 37 of an extension 35. Again with this embodiment, the elastomeric insert 32 could be omitted, and a rubber or plastic washer could be provided between the underside of the base member 16 and the head of the bolt 42.

The drawings illustrate the presently preferred shape of the base member 16, namely a semi-circular, cross-sectional shape, which provides easy access to the male threads 28 of an anchor 23 that has been placed in the sub-surface 24 of a channel 12, or to the nipple 38 for placement of a lock nut 39 or similar securement means thereon. Other shapes for the base member 16 are also possible.

To further secure the connection of the upright members 17, and in particular via their extensions 35, to the anchors 23 and/or to the base member 16, the grommet saddle 31, and that part of the extension 35 that faces and is seated on the grommet saddle, are provided with engagement means that cooperate with one another to prevent, or at least to make difficult, an unintentional unthreading of the upright members 17, with their extensions 35, from the anchor 23 and/or the nipple 38 that is secured to the base member 16. To provide this cooperating, interlocking effect, at least two diametrically opposed projections in the form of nubs or ramps can be provided on the grommet saddle 31, while the facing surface of the bottom of the extension 35 is provided with a plurality of complementary recessed portions. When the extension 35 is being threaded onto the anchor 23 or onto the nipple 38, and the bottom of the extension 35 approaches the grommet saddle 31, the extension 35 can move over and slightly compress the ramps of the grommet saddle 31, which ramps rise in a clockwise direction, until the ramps are received in recesses of the extension 35. After the extension 35 has been completely threaded onto the nipple 38 or the anchor 23, the ramps are completely accommodated in the recesses of the extension. Since an attempted unthreading rotation of the threaded-together components will cause substantially axially extending back surfaces of the higher portions of the ramp to encounter similarly substantially extending surfaces of the recesses of the extension 35, the extensions 35, and hence the upright members 17, cannot easily be unthreaded from the nipples 38 or anchors 23.

As indicated above, a scour apron 14 can be disposed on the downstream side of the drainage and material-settling device to prevent erosion that could otherwise be caused by the accelerated flow on the downstream side of the device 10. When the drainage and material-settling device 10 is in place on the scour apron 14, only the upstream edge of the base member 16 will be beyond the apron and will be placed directly upon the channel or ditch surface. Holes can be provided in the scour apron 14 in line with the holes in the base member 16 that are provided for the anchors 23.

Although the above description of applicant's drainage and material-settling device 10 has been in conjunction with a transverse arrangement of a single row of equidistantly spaced-apart upright members 17 (see FIGS. 1A and 1B, as well as FIGS. 7A and 7B), which provides, by way of example only, a 40% porosity to flow, other configurations for the arrangement, spacing and even length of the upright members 17 are also possible. Therefore, again by way of example only, reference wifi be made to the exemplary embodiments illustrated in FIGS. 8-12.

Figure 8A:
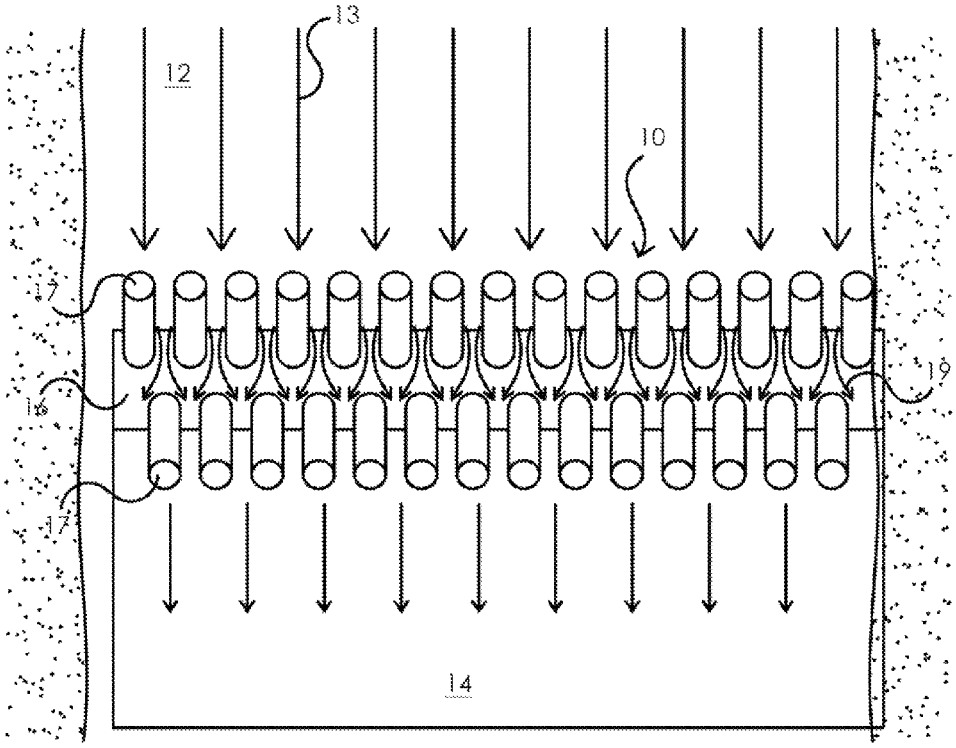
FIG. 8A is a top view onto another exemplary configuration of applicant's drainage and material settling device.
Figure 8B:
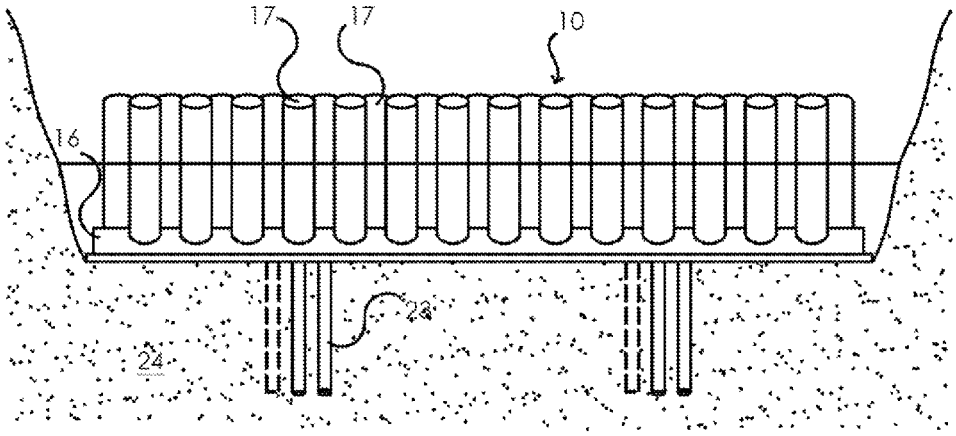
FIG. 8B is a front view of the drainage and material settling device of FIG. 8A.
Figure 9A:
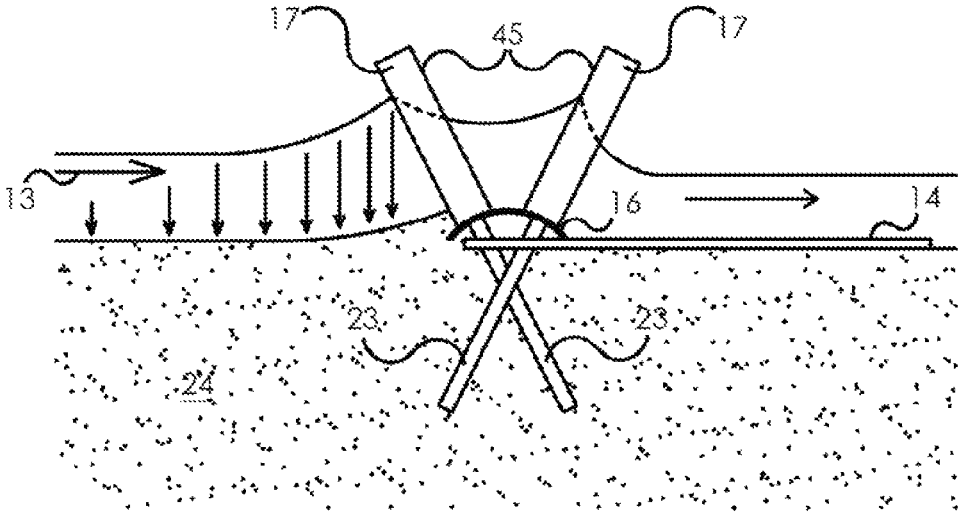
FIG. 9A is a side view of the drainage and material settling device of FIG. 8A.
Figure 9B:
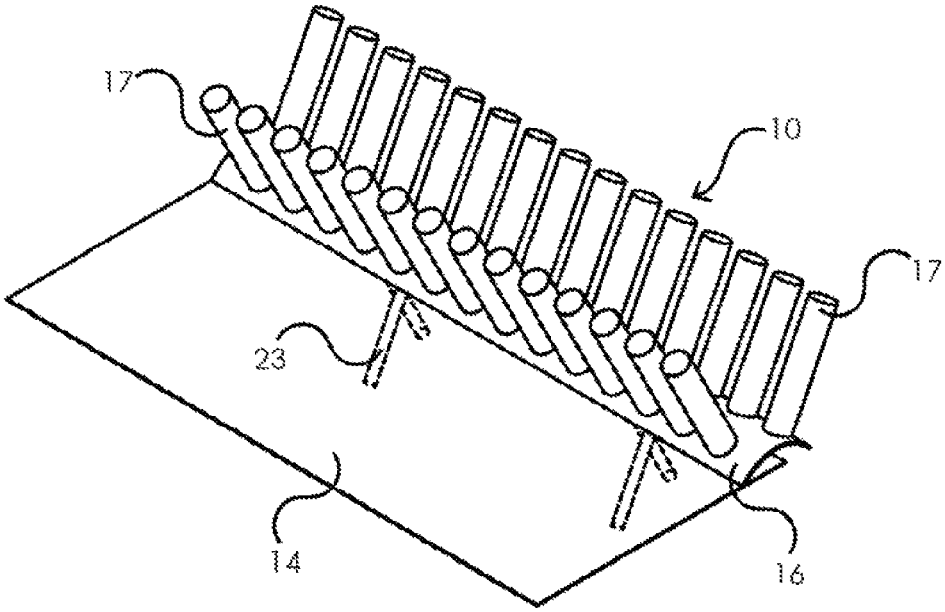
FIG. 9B is an isometric view of the drainage and material settling device of FIG. 8A.

In the embodiment illustrated in FIGS. 8A through 9B, again a single base member 16 is provided. However, instead of a single row of upright members 17, two rows of upright members are provided. The two rows are disposed at an angle to one another, and the upright members 17 of one of the rows is offset with respect to the upright members 17 of the other row. As can be seen particularly clearly in FIGS. 8A and 8B, the angle 45 (see FIG. 9A) between the upright member 17 of one of the rows of upright members and the upright member 17 of the other row of upright members can range, for example, from 30 degrees to 60 degrees, i.e. 15 to 30 degrees from vertical. At least two anchors 23 for two of the upright members 17 that are inclined in the upstream direction are provided, although further anchors for that row of upright members or the other row of upright members can also be provided, as illustrated in FIGS. 8B, 9A and 9B.

Figure 10A:
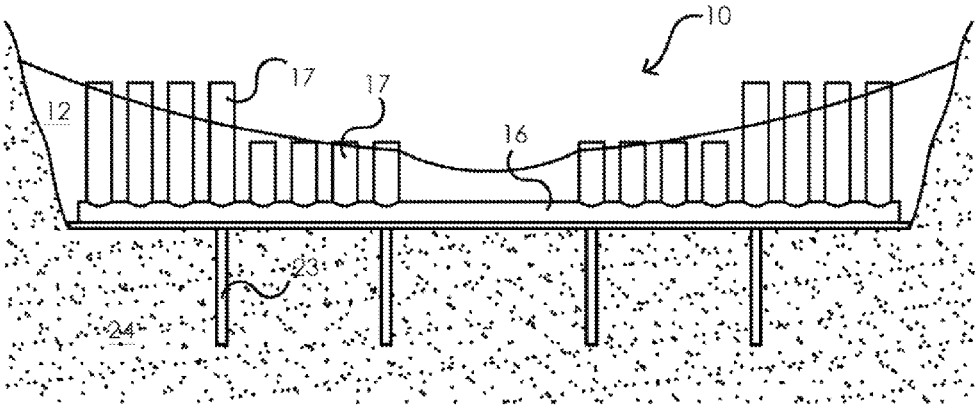
FIG. 10A is a front view of a further exemplary configuration of applicant's drainage and material settling device.
Figure 10B:
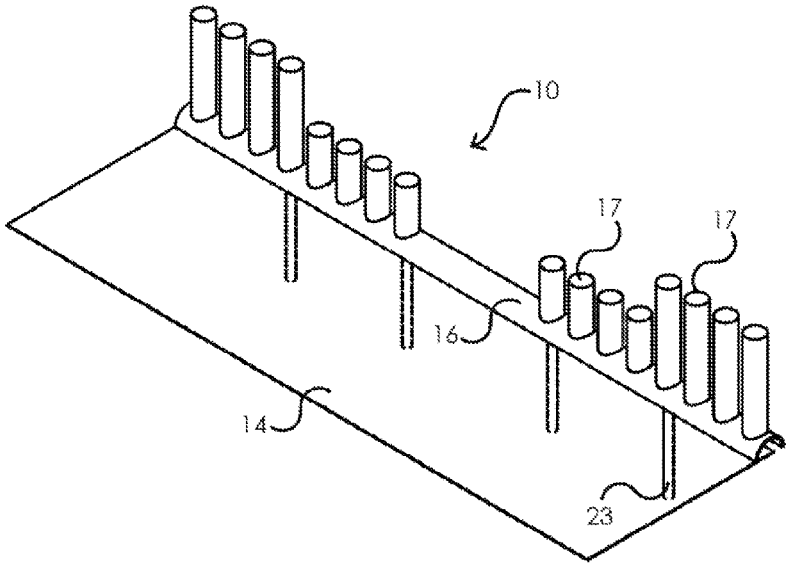
FIG. 10B is an isometric view of the drainage and material settling device of FIG. 10A.

The embodiment of applicant's drainage and material-settling device 10 illustrated in FIGS. 10A and 10B shows that not only the individual heights of the upright member 17 need not necessarily all be the same, but also the spacing between the upright members 17 need not be equidistant. In the illustrated embodiment, a gap has been shown in the center of the device 10 between the upright members 17 on either side thereof. However, rather than such a pronounced gap, upright members 17 can be disposed all the way across the base member 16 from one side of the channel 12 to the other, and either the height of the upright member 17 can vary, or the spacing between adjacent upright members 17 can vary. In addition, those upright members 17 toward the middle of the device 10 could be closer together than those near the sides, or vice versa, or the spacing between adjacent upright member 17 can progressively increase or decrease from the middle toward the sides. The heights of the upright member 17 could also progressively increase or decrease, either from one to the other or in groups, from the center toward the sides.

Figure 11A:
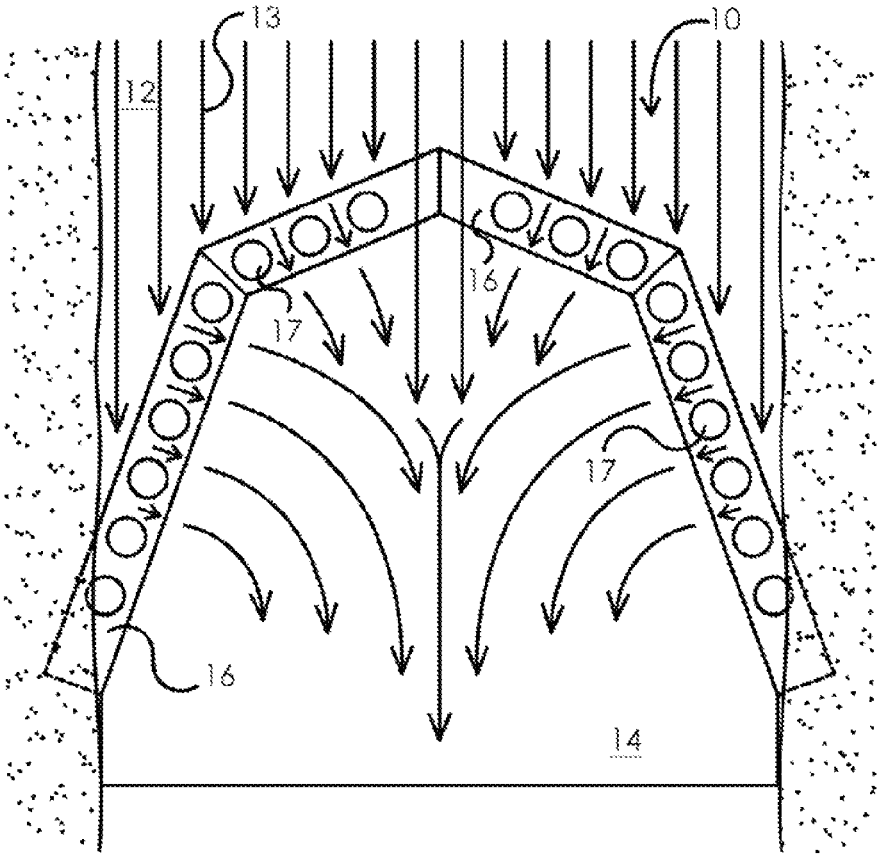
FIG. 11A is a top view of another exemplary configuration of applicant's drainage and material settling device.
Figure 11B:
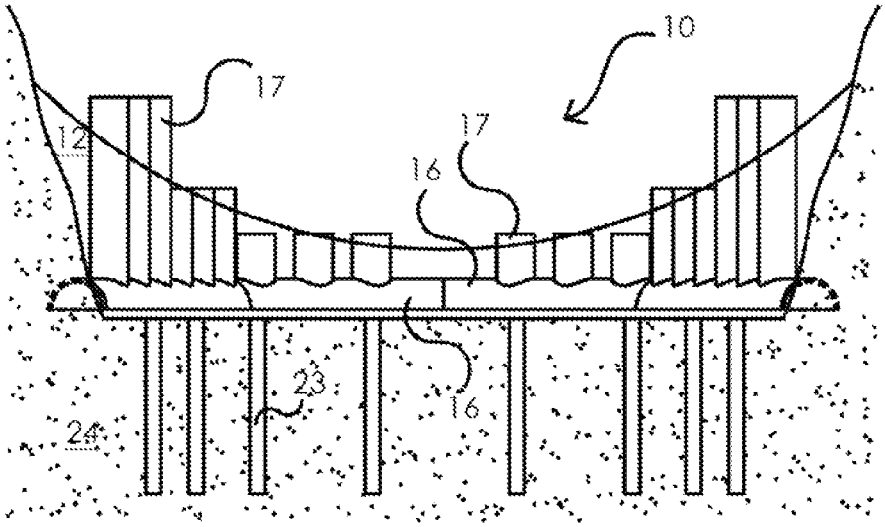
FIG. 11B is a partially sectioned front view of the drainage and material settling device of FIG. 11A.
Figure 12A:
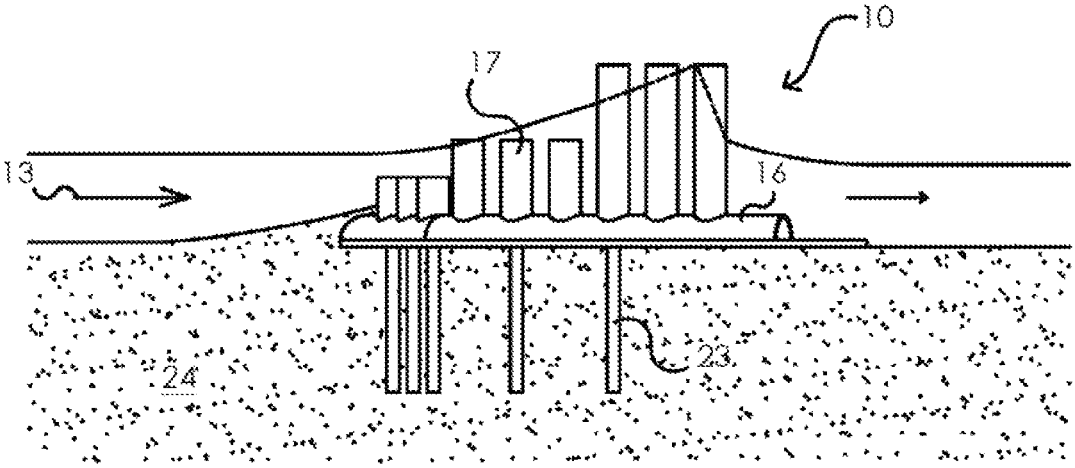
FIG. 12A is a partially sectioned side view of the drainage and material settling device of FIG. 11A.
Figure 12B:
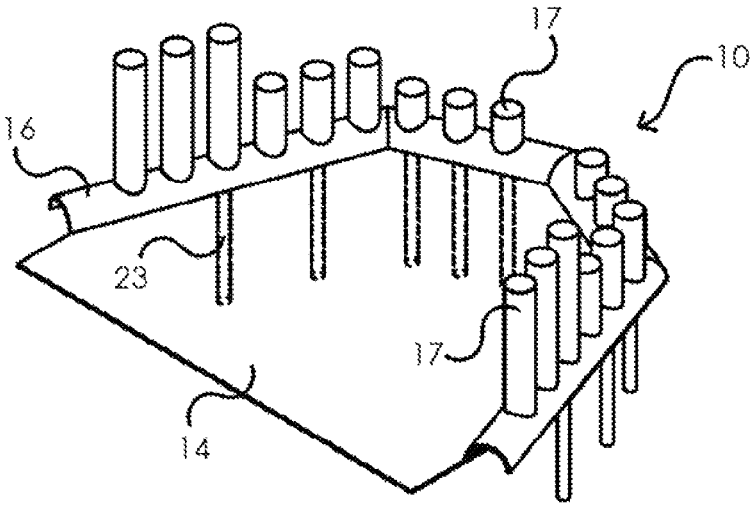
FIG. 12B is an isometric view of the drainage and material settling device of FIG. 11A.

FIGS. 11 and 12 show yet another exemplary embodiment of applicant's drainage and material-settling device 10. Here, instead of the device 10 being disposed across the channel 12 substantially perpendicular to the main direction of flow 13 in the channel, the device 10 can be comprised of a plurality of individual devices, each of which is disposed transverse to the main direction of flow 13, preferably at varying angles thereto (see, in particular, FIG. 11A). In the illustrated embodiment, four separate sections are provided, each of which comprises the base member 16, upright members 17 of varying heights, and at least two anchors 23 for each of the base members. Using multiple sections for the device, even in a narrower channel or ditch, can allow the upstream angling of the overall device, especially where flows are anticipated to be stronger.

The present invention is, of course, in no way restricted to the specific disclosure of the specification and drawings, but also encompasses any modifications within the scope of the appended claims.

What I claim is:

1. A drainage and material-settling device for conveyance channels, comprising:

an elongated base member configured to be placed in a channel transverse to a main direction of flow through the channel;

a plurality of spaced-apart upright members that extend from a first side of said base member;

at least two anchor members that extend from a second side of said base member remote from said first side, wherein said anchor members are configured to be placed in a subsurface of the channel such that said upright members extend into the channel away from said base member, and wherein that number of said upright members corresponding to the number of anchor members are secured to said anchor members such that said base member is sandwiched between said anchor members and said upright members; and further connecting members, wherein those upright members not secured to said anchor members are secured to said further connecting members and hence to said base member.

2. A device according to claim 1, which further includes respective extensions mounted to an end of said upright members, wherein a free end of each of said extensions is secured to one of said anchors or to one of said further connecting members.

3. A device according to claim 2, wherein said free end of each of said extensions has a threaded portion for securement to cooperating threads of one of said anchors or one of said further connecting members.

4. A device according to claim 3, which further includes a respective grommet saddle disposed between said base member and said free end of each of said extensions, wherein each of said grommet saddles has a central aperture for receiving therethrough threads of said anchors or of said connecting members.

5. A device according to claim 4, wherein part of said free end of each of said extensions extends radially outwardly from said threaded portion thereof and is configured to rest upon said grommet saddle radially outwardly of said aperture thereof.

6. A device according to claim 5, wherein said free end of said extension, and said grommet saddle, are respectively provided with cooperating interengaging elements that inhibit unthreading of said extension from threads of said anchor members or of said further connecting members.

7. A device according to claim 5, wherein said further connecting member is in the form of a nipple, one end of which is threaded for connection to said threaded portion of said extension.

8. A device according to claim 7, wherein another end of said nipple is threaded and extends through said aperture in said grommet saddle and through said base member, and wherein a lock nut is provided for threaded connection to said another threaded end of said nipple on a side of said base member remote from said free end of said extension.

9. A device according to claim 7, which further includes an elastomeric insert having ribbing on an outer surface thereof, wherein said elastomeric insert is configured to be disposed in said aperture of said grommet saddle and in a hole in said base member, and wherein another end of said nipple is configured to extend through said elastomeric insert such that it presses said ribbing thereof against a wall of said hole in said base member to effect securement of said upright member, via the interposition of said extension, to said base member.

10. A device according to claim 2, wherein said upright members have a tubular configuration.

11. A device according to claim 10, wherein an end of each of said extensions opposite said free end thereof has a reduced-diameter extension configured to be press fit into said tubular upright member.

12. A device according to claim 1, wherein said base member is disposed substantially perpendicular to the main direction of flow through the channel.

13. A device according to claim 1, wherein said base member Is disposed at an angle to the main direction of flow through the channel.

14. A device according to claim 1, which includes at least one further base member, wherein all of said base members are configured to be placed in the channel transverse to the main direction of flow through the channel.

15. A device according to claim 14, wherein all of said base members are disposed in a straight line, are disposed at angles relative to one another or are disposed parallel to one another.

16. A device according to claim 1, wherein said base member has a curved or arched cross-sectional shape.

17. A device according to claim 1, wherein said upright members extends substantially perpendicular to a surface of the channel, or at an angle relative to such surface.

18. A device according to claim 1, wherein said upright members are spaced equidistantly apart, or are spaced at varying distances from one another.

19. A device according to claim 18, wherein said upright members extend in the same direction or at angles relative to one another.

20. A device according to claim 1, wherein each of said anchor members and said further connecting members is configured to extend partially through said base member.

21. A drainage and material-settling device for conveyance channels, comprising:

an elongated base member configured to be placed in a channel transverse to a main direction of flow through the channel;

a plurality of spaced-apart upright members that extend from a first side of said base member;

at least two anchor members that extend from a second side of said base member remote from said first side, wherein said anchor members are configured to be placed in a subsurface of the channel such that said upright members extend into the channel away from said base member, and wherein that number of said upright members corresponding to the number of anchor members are secured to said anchor members such that said base member is sandwiched between said anchor members and said upright members;

further connecting members, wherein those upright member not secured to said anchor members are secured to said further connecting members and hence to said base member; and respective extensions mounted to an end of said upright members, wherein a free end of each of said extensions is secured to one of said anchors or to one of said further connecting members.

* * * * *